US006902086B1

(12) United States Patent
Norrid

(10) Patent No.: US 6,902,086 B1
(45) Date of Patent: Jun. 7, 2005

(54) METHOD AND APPARATUS FOR CONSTRUCTING DECORATIVE ARRANGEMENTS

(76) Inventor: Jean F. Norrid, 15155 Kimberly Ct., Houston, TX (US) 77079

( * ) Notice: Subject to any disclaimer, the term of this patent is extended or adjusted under 35 U.S.C. 154(b) by 0 days.

(21) Appl. No.: 10/159,631

(22) Filed: May 30, 2002

Related U.S. Application Data

(60) Provisional application No. 60/297,385, filed on Jun. 11, 2001.

(51) Int. Cl.[7] ..... A41H 43/00
(52) U.S. Cl. ..... 223/46
(58) Field of Search ..... 223/46, 44; 163/1; 28/147

(56) References Cited

U.S. PATENT DOCUMENTS

| | | | | | |
|---|---|---|---|---|---|
| 12,479 | A | * | 3/1855 | Crum | 426/19 |
| 1,880,219 | A | * | 10/1932 | Sparke | 24/711.3 |
| 2,873,708 | A | * | 2/1959 | Boltach | 112/475.01 |
| 3,229,484 | A | * | 1/1966 | Standart | 66/118 |
| 3,229,870 | A | | 1/1966 | Capstick | 223/46 |
| 3,233,800 | A | * | 2/1966 | Catania | 223/102 |
| 3,678,712 | A | * | 7/1972 | Singleton | 66/118 |
| 4,449,652 | A | | 5/1984 | Coppins et al. | 223/46 |
| 4,527,719 | A | * | 7/1985 | Mackrill | 223/44 |
| 4,651,908 | A | | 3/1987 | Ford | 223/46 |
| 4,773,343 | A | * | 9/1988 | Riche | 112/475.15 |

* cited by examiner

*Primary Examiner*—John J. Calvert
*Assistant Examiner*—James G Smith
(74) *Attorney, Agent, or Firm*—Conley Rose, P.C.

(57) ABSTRACT

An apparatus and associated method for constructing decorative arrangements includes a disc member having a plurality of perforations arranged in a pattern formed therein and a tool for inserting fabricating material into selected ones of the plurality of perforations formed in the disc member. An end of the tool is used to forcibly inserting an end of the fabricating material through a first perforation formed in the disc member. Markings on an intermediate section of the tool are used to measure a selected length of the fabricating material. The other end of the selected length is then inserted into a second perforation formed in the disc member to form a loop of fabricating material attached to the disc member. This process is then repeated using additional perforations, thereby adding additional loops of the fabricating material to the disc member, until construction of the decorative arrangement is completed.

21 Claims, 4 Drawing Sheets

METHOD AND APPARATUS FOR CONSTRUCTING DECORATIVE ARRANGEMENTS

CROSS REFERENCE TO RELATED PROVISIONAL APPLICATION

This application is related to provisional U.S. patent application Ser. No. 60/297,385 filed Jun. 11, 2001.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The invention is directed to a method and apparatus for constructing decorative arrangements and, more particularly, to a method and apparatus for constructing a wide variety of decorative arrangements from a disc having perforations formed therein and a length of fabricating material.

BACKGROUND OF THE INVENTION

Originally, bows and other decorative arrangements were made by hand. This time-consuming and tiring operation limits not only the quantity, but also the quality of the bows or other decorative arrangements. Skilled operators become more proficient with practice, but their ability to produce substantial quantities of such decorative arrangements is limited. The process of making bows by hand is difficult, if not impossible, for the unskilled operator to master with any degree of quality and quantity.

Various attempts have been made to assist bow makers. These have included devices comprising long nails protruding from a wooden board to crude devices, or patterns, made of metal with metal prongs. It is also known to make devices and forms that assist in creating bows from fabric or other fabricating material such as ribbons. These devices fall into two categories. The first category consists of large, complicated, expensive commercial machines such as that illustrated in U.S. Patent No. 4,449,652 to Coppins, the prices of which are out of reach of the average individual or small businesses such as florists. The second category consists of small and inexpensive devices and forms such as those described in U.S. Pat. No. 3,229,870 to Capstick and U.S. Pat. No. 4,651,908 to Ford. However, these latter devices suffer from the disadvantage that they limit the creativity and applications of the user because they generally make only one (or a few) size(s) and type(s) of bows or other decorative arrangements. Furthermore, the bows or decorative arrangements made with these devices and methods require wire, glue, or other means to maintain their shape and configuration. No known prior art apparatus for making bows or other decorative arrangements is adjustable such that the bows or other decorative arrangements may be constructed in a variety of shapes and sizes. Furthermore, so far as known, no prior device that allows the bow or other decorative arrangement to be made using materials of various widths is available. Finally, prior devices typically limit the size of each individual loop of the bow or other decorative arrangement. As a result, the variety of designs which may be constructed using such devices is limited.

SUMMARY OF THE INVENTION

The present invention is directed to an apparatus and method of making decorative arrangements which avoids many of the shortcomings of such prior devices. By using the disclosed apparatus, the size of the decorative arrangement may be adjusted incrementally. The number of loops in a decorative arrangement is determined by the user, and can vary from two up to thirty, forty or even more if the user so desires. Neither the width of the material from which the decorative arrangements are made nor the length of the loops is predetermined for the user. The user can also select from narrow to very wide material and the material is pre-cut only after the user determines the number of loops and the size (or diameter) of the desired decorative arrangement.

The present invention is also relatively inexpensive and affordable to make and sell such that hobbyists can afford to purchase them and florists and other business people who use decorative arrangements in their products can afford to purchase more than one. Furthermore, since the present invention does not require wire, glue, or other means for maintaining the shape or configuration of the decorative arrangement, there is no center gathering of bow-fabricating material. Thus, the decorative arrangement can be made with an open center that allows the arrangement to be readily placed over or onto objects to be decorated such as Christmas trees, door knobs, candles, flower arrangements and the like.

Accordingly, in one embodiment, the present invention is directed to an apparatus for constructing decorative arrangements which includes a disc member having at least two perforations formed therein and a tool for inserting fabricating material into the perforations formed in the disc member to form at least one loop of the fabricating material. In one aspect, a plurality of perforations arranged in a pattern are formed in the disc member. In another, the tool may include an end for forcibly inserting portions of the fabricating material through selected ones of the plurality of perforations and an intermediate section having a series of markings used for measuring lengths of the fabricating material and the loops formed thereby after the end of the tool has forcibly inserted the portions of the fabricating material through selected ones of the plurality of perforations. In still another, the apparatus may further include a pattern for identifying the order in which the plurality of perforations are selected for insertion of respective lengths of the fabricating material therethrough.

In another embodiment, the present invention is directed to a method of constructing a decorative arrangement. In accordance with this method, a disc member having formed therein, a plurality of perforations arranged in a pattern is provided. An end of a length of a strip of fabricating material is then inserted into a first one of the plurality of perforations. A length of the strip of fabricating material is measured out and an intermediate section of the strip of material located at the end of the measured length is then inserted into a next one of the plurality of perforations to form a loop. Additional loops are then formed by repeatedly measuring out additional lengths of the strip of fabricating material and inserting intermediate sections of the strip of fabricating material located at the ends of the measured lengths into additional ones of the plurality of perforations. This process continues until construction of the decorative arrangement is completed. In one aspect thereof, a tool having an end and an intermediate section having a series of markings thereon is provided. The end of the tool is used for forcibly inserting the strip of fabricating material through the plurality of perforations. In another, the first loop is formed by using the series of markings to measure the distance separating the perforation in which the end of the strip of fabricating material was inserted and the intermediate section of the strip of fabricating material. In still another, the first loop is formed by twisting the strip of material at the end of the measured length, positioning the twisted intermediate section of the strip of fabricating material over the next one of the plurality of perforations and inserting the intermediate section of the strip of fabricating material into the next one of the plurality of perforations.

DETAILED DESCRIPTION OF THE INVENTION

Figure 1A:
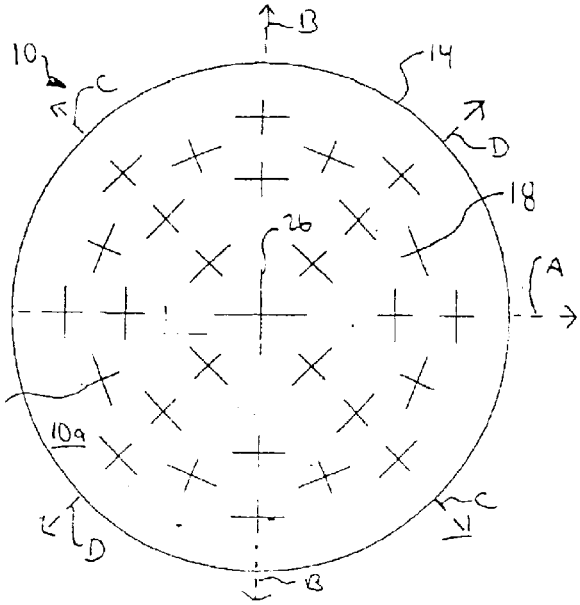
FIG. 1A is a top view of a patterned retaining disc for making decorative arrangements.
Figure 1B:
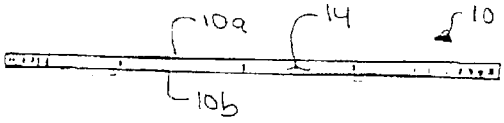
FIG. 1B is a side view of the patterned retaining disc of FIG. 1A.

Referring first to FIGS. 1A–B, a patterned retaining disc 10 constructed in accordance with the teachings of the present invention and suitable for use in making decorative arrangements may now be seen. As will be more fully described below, the patterned retaining disc 10 provides both a pattern for fabricating a decorative arrangement and a means for retaining the cloth, ribbon, or other fabricating material that is being used, in conjunction with the patterned retaining disc 10, to construct a bow or other decorative arrangement. The patterned retaining disc 10 includes generally circular upper and lower side surfaces 10*a* and 10*b* which are separated by a relatively thin circular sidewall 14. The patterned retaining disc 10 is formed using a resiliently deformable material, for example, polyethylene, or a similar material. While it is fully contemplated that the patterned retaining disc 10 may be variously dimensioned, forming the patterned retaining disc 10 to have a diameter of about 2¾ inches or about 3½ inches are particularly well suited for the uses contemplated herein since the aforementioned sizes enable a user to easily grasp the patterned retaining disc 10 in the palm of their hand. It is further contemplated that the patterned retaining disc 10 should he sufficiently thin to be readily flexed when held by the user.

As may be further seen in FIG. 1A, a plurality of perforations 18, each of which extend from the upper side surface 10*a* to the lower side surface 10*b*, are formed in the patterned retaining disc 10 so that fabricating material (not shown in FIGS. 1A–B) inserted therethrough may be held thereby. As illustrated herein, the perforations 18 formed in the patterned retaining disc 10 are formed in an "X" or "cross" shape to facilitate insertion of the fabricating material into the perforations 18 in the manner described below. Of course, it should be clearly understood that the perforations 18 may have different configurations. For example, a "Y" shape, will be equally suitable for the uses contemplated herein. Generally, however, the perforations 18 should be shaped such that, in response to a force exerted thereon, the perforations 18 will deform to allow the passage of material therethrough and, upon removal of the force, the perforations will return to their original shape, thereby securing the material inserted therethrough to the patterned retaining disc 10.

It is further contemplated that the perforations 18 formed in the patterned retaining disc 10 be arranged in a pattern. For example, as illustrated in FIG. 1A, four perforations 18 are formed along horizontal axis A, four perforations 18 are formed along vertical axis B, six perforations are formed along diagonal axis C, six perforations are formed along diagonal axis D and two perforations 18 are formed along each of additional axes located intermediate to the axes A, B, C and D. As may be further seen in FIG. 1A, along each of the axes A, B, C and D, as well as the axes intermediate thereto, the perforations 18 formed therealong are spaced an equal distance apart from one another. Of course, the illustrated pattern of perforations 18 formed in the patterned retaining disc 10 is but one of many suitable patterns of perforations which may be formed therein.

As may be further seen in FIG 1A, the patterned retaining disc 10 is further provided with an enlarged perforation 26, again formed in an "X" or "cross" shape, that is located at or near the center of the patterned retaining disc 10, preferably at the intersection of the axes A, B, C and D. It is contemplated that the enlarged perforation 26 may be used, if desired, to receive items other than the fabricating material received by the perforations 18, thereby enabling the decorative arrangement constructed using the patterned retaining disc apparatus 10 to be used, for example, as the decorative base of a candlestick, or a Christmas tree decoration. For example, when the patterned retaining disc 10 is used as the decorative base of a candlestick, a base portion of the candle would be inserted into the enlarged perforation 26. Similarly, when the patterned retaining disc 10 is used as a Christmas tree decoration, a branch of the Christmas tree would be inserted into the enlarged perforation 26. It is fully contemplated, however, that the enlarged perforation 26 need not be located in the general center of the patterned retaining disc 10. For example, for certain types of decorations and/or bows, it may be desirable to locate the enlarged perforation 26 elsewhere along the patterned retaining disc 10. Similarly, as many decorative arrangements do not even need an enlarged perforation 26 in the general center of or elsewhere along the patterned retaining disc 10, it is further contemplated that, in one embodiment of the invention, the enlarged perforation 26 may be omitted altogether.

It is contemplated that the material from which the patterned retaining disc 10 is fabricated should be sufficiently flexible such that the edges of the perforations 18 will affirmatively grip and hold the material inserted therein. Thus, as previously set forth, one material suitable for the uses contemplated herein is a polyethylene plastic. However, it should be clearly understood that the patterned retaining disc 10 may be constructed from any suitable material which is sufficiently flexible such that material inserted in the perforations 18 will be affirmatively gripped and held thereby. Similarly, while the patterned retaining disc 10 is illustrated in FIGS. 1A–B as having a generally circular shape, it should be clearly understood that the patterned retaining disc 10 may assume a wide variety of other geometric configurations.

Figure 1E:
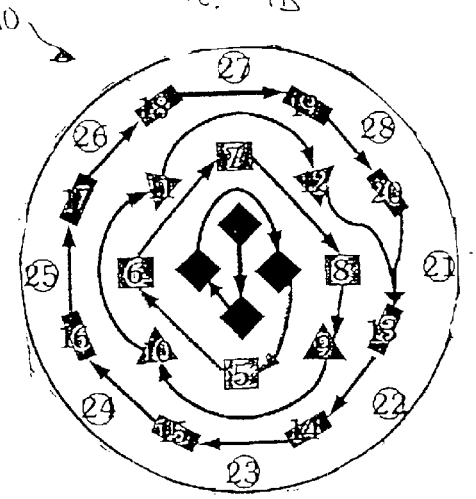
FIG. 1E is a schematic view of a pattern to follow when making decorative arrangements using the patterned retaining disc of FIGS. 1A–1B, the strip of fabricating material FIG. 1C and the tool of FIG. 1D.
Figure 1C:
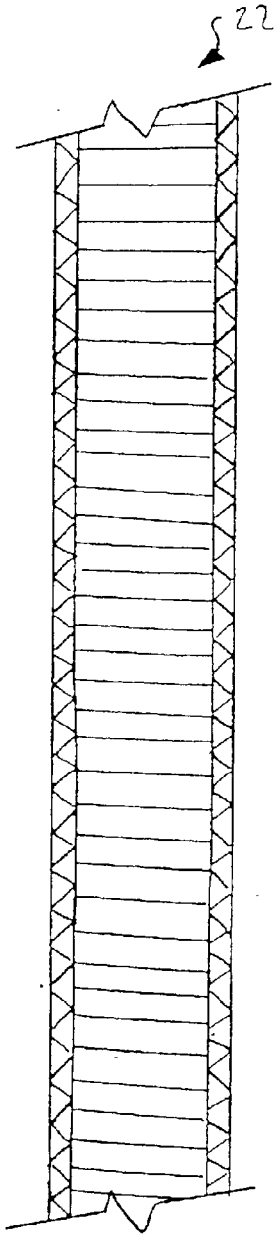
FIG. 1C is a top view of a strip of fabricating material, suitable for use with the patterned retaining disc of FIGS. 1A–1B, when making decorative arrangements.

Referring next to FIG. 1C, a strip of fabricating material 22 used, together with the patterned retaining disc 10 to construct a decorative arrangement may now be seen. Generally, a wide variety of fabricating materials are suitable for use when constructing a decorative arrangement. For example, any one of a number of commercially available ribbons is suitable for use as the fabricating material. It is further contemplated that the width and/or length of the ribbon or other fabricating material used to construct a decorative arrangement may be varied depending on certain characteristics of the decorative arrangement to be constructed therewith. Table 1, below, lists various widths and lengths of ribbon which may be used to construct bows of various sizes. Table I, below, further lists the loop lengths for the ribbons which are selected during construction of these bows.

TABLE I

| Ribbon Width | Yards of Ribbon Required | Loop Length | Bow Size |
|---|---|---|---|
| 1.0" | 4.0–5.0 | 4–5" | 4–5" |
| 1.5" | 4.5–5.0 | 5–6" | 5–6" |
| 2.0" | 5.0–5.5 | 6–7" | 6–7" |
| 2.5" | 6.0–7.0 | 8–9" | 8–9" |
| 3.0" | 7.0–7.5 | 9–10" | 9–10" |

Figure 1D:
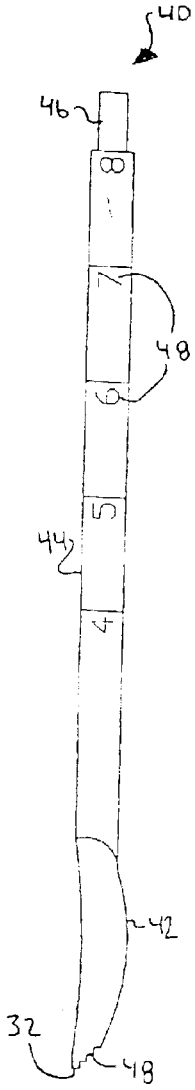
FIG. 1D is a side view of a tool, suitable for with the patterned retaining disc of FIGS. 1A–1B and the strip of fabricating material of FIG. 1C, when making decorative arrangements.

Referring next to FIG. 1D, a tool 40 used in combination with the patterned retaining disc 10 and the strip of fabricating material 22, to construct a decorative arrangement will now be described in greater detail. As may now be seen, the tool 40 is comprised of a lower section 42, an elongated middle section 44 and an upper section 46. The lower section 42 is shaped to facilitate the insertion of the strip of fabricating material 22 through the perforations 18. More specifically, the lower section 42 has a toothed surface 48 formed thereon which frictionally engages the strip of fabricating material 22 as it is being pushed through a selected one of the perforations 18. Because the tool 40 is used to forcibly insert the strip of fabricating material through selected perforations 18, it is preferably formed of a rigid plastic material. Of course, it is fully contemplated that the tool may be formed using other suitable materials. For example, by forming the tool 40 from a slightly flexible material, it is contemplated that the gripping of the tool 40 by the user constructing the decorative arrangement may be facilitated. As may be further seen in FIG. 1D, the middle section 44 of the tool 40 has a series of markings 48 representing the distance, in inches, from the respective markings 48 to a lowermost edge surface 32 of the tool 40. As will be more fully described below, the markings 48 are provided to enable the user to easily and accurately measure lengths of the strip of fabricating material 22 when constructing the decorative arrangement.

Referring next to FIG. 1E, the construction of a decorative arrangement using the patterned retaining disc 10 the strip of fabricating material 22 and the tool 40 will now be described in greater detail. First, the shape, size and number of loops of a desired decorative arrangement are determined and an appropriate length of the strip of fabricating material 22 is selected. A patterned retaining disc 10 having the desired size, shape and pattern is then selected. The user secures the selected patterned retaining disc 10 in place, for example, by holding the patterned retaining disc 10 in their hand, with the front side surface 10*a* facing up. An end of the strip of fabricating material 22 is twisted twice and then inserted, from the front side surface 10*a* thereof, approximately ¼ inches into perforation number 1 using the toothed surface 48 of the lower section 42 of the tool 40. Placing the lowermost edge surface 32 of the tool 40 against the perforation 1, a length of the fabricating material 22 corresponding to the size of the desired loop is measured using the markings 48 formed on the middle section 44 of the tool 40. Once the desired length of the strip of fabricating material 22 has been measured, the strip of fabricating material 22 is twisted twice at this point. The process is then repeated, this time, inserting the twisted strip of fabricating material 22 approximately ¼ inches into perforation number 2, thereby forming a first loop from the strip of fabricating material 22. Working in a clockwise fashion (or the reverse, if the user is left-handed), the aforementioned steps are repeated until twisted segments of the strip of fabricating material 22 have been inserted into each one of perforations 3–20, thereby forming a series of loops spaced around the front side surface 10*a* of the patterned retaining disc 10. The final loop of the series of loops is then completed by inserting a second end of the strip of fabricating material 22 into perforation 13.

Having covered the front side surface 10*a* of the patterned retaining disc 10 with a series of loops of the fabricating material 22, the perforations 21 through 28 are then used to cover the back side surface 10*b* thereof, again with a series of loops. The user first cuts eight strips of the fabricating material 22, each, for example, four inches long. The user re-secures the patterned retaining disc 10 in their hand, again with the front side surface 10*a* facing up. Using the tool 40, a first end of each strip of the fabricating material 22 is inserted, from the front side 10*a* thereof, into perforations 21 through 28, respectively. The other end of each strip of material is then inserted into the enlarged perforation 26 on the back side surface 10*b*, thereby completing construction of the desired decorative arrangement, apart, of course, from some final trimming steps used to further enhance the appearance of the decorative arrangement. Of course, the appearance of the constructed decorative arrangement may be still further enhanced by adding additional material using a variety of techniques. For example, one or more tails of a desired length may be added to the decorative arrangement by removing the end of one of the strips of the fabricating material 22 inserted into the enlarged perforation 26, inserting the center of each tail being added through the enlarged perforation 26 and then re-inserting the removed end back through the enlarged perforation 26. Finally, to attach the constructed decorative arrangement onto an item, for example, a wrapped package, two inches of a first end of a ribbon should be inserted through the enlarged perforation 26. The ribbon should then be wrapped around the length of the item and the other end inserted through the enlarged perforation 26. The ribbon should then be secured by tying together the two ends thereof which were inserted through the enlarged perforation 26.

Figure 2A:
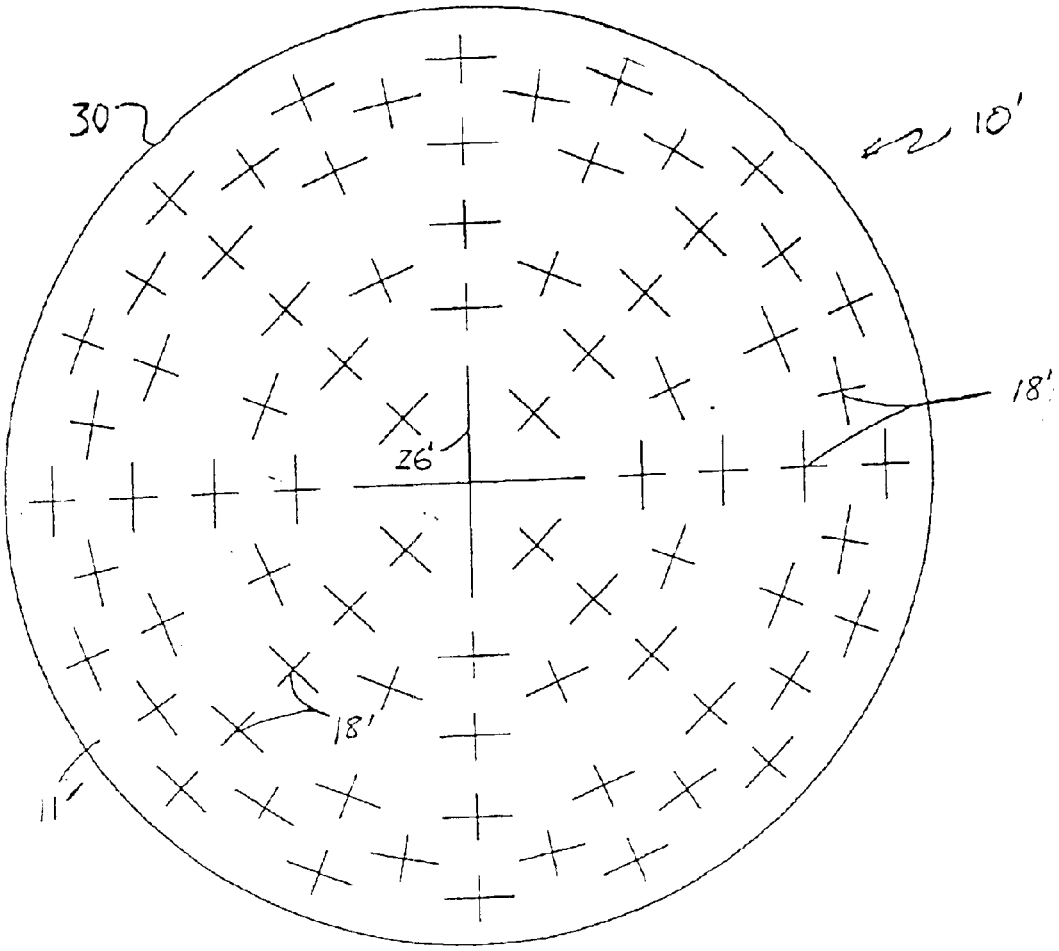
FIG. 2A is a top view of an alternate embodiment of the patterned retaining disc of FIGS. 1A–B.
Figure 2B:
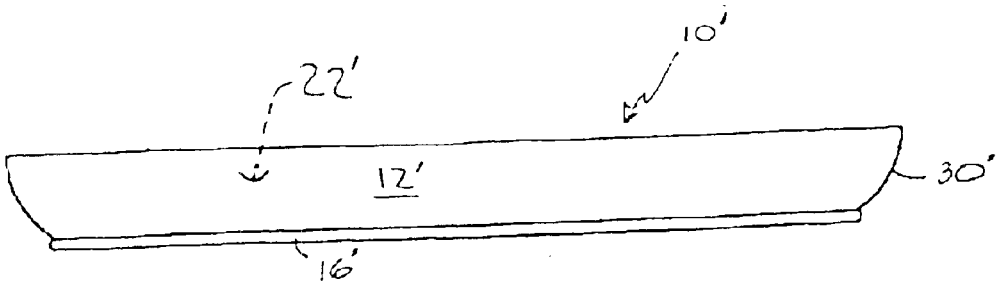
FIG. 2B is a side view of the patterned retaining disc of FIG. 2A.

Referring next to FIGS. 2A and 2B, an alternate embodiment of the patterned retaining disc 10 hereafter referred to as patterned retaining disc apparatus 10', may now be seen. As before, the patterned retaining apparatus 10' provides a pattern for fabricating a decorative arrangement and a means for retaining the cloth, ribbon, or other material that is being used to fabricate a decorative arrangement or bow in accordance with the method of the present invention described herein. The patterned retaining disc apparatus 10' is comprised of a patterned retaining disc 11' similar to the patterned retaining disc 10 described and illustrated in FIGS. 1A–B and a dish 12' integrally formed with and/or securedly attached to the patterned retaining disc 11'.

The patterned retaining disc 11' is provided with a plurality of perforations 18' for retaining the material (not shown in FIGS. 2A–B) from which the decorative arrangement is constructed. The dish 12' integrally formed with and/or securedly attached to the patterned retaining disc 11' is comprised of a continuous curvilinear sidewall 30' extending upwardly from a generally flat, thickened, or rolled edge, bottom 16' to define an interior 22' (located immediately below the patterned retaining disc 11') for receiving material inserted through the perforations 18'. Preferably, both the patterned retaining disc 11' and the dish 12' of the patterned retaining disc apparatus 10' are constructed of a relatively inexpensive material, for example, a polyethylene plastic, that is inexpensive to mold or otherwise manufacture and is amenable to being manufactured in large quantity. Another material suitable for use as the patterned retaining disc apparatus 10' is cardboard that is folded into the illustrated shape of the patterned retaining disc apparatus 10'.

In the embodiment of the invention illustrated herein, the perforations 18' formed in the patterned retaining disc 11' are again formed in an "X" or "cross" shape to facilitate insertion of the fabricating material 22 into the perforations 18'. Of course, it should again be clearly understood that the perforations 18' formed in the patterned retaining disc 11' may have different configurations, for example, a "Y" shape and/or the number of perforations 18' formed in the patterned retaining disc 11', and/or the arrangement of the perforations 18' on the patterned retaining disc 11' may be readily varied without departing from the scope of the present invention.

As may be further seen in FIG. 2A, the patterned retaining disc 11' is further provided with an enlarged slotted perforation 26', again formed in an "X" or "cross" shape, located at or near the center of the patterned retaining disc 11'. It is again contemplated that the enlarged perforation 26' may be used, if desired, to receive items other than the fabricating material received by the perforations 18', thereby once again enabling the decorative arrangement constructed using the patterned retaining disc apparatus 10' to be used, for example, as the decorative base of a candlestick, or a Christmas tree decoration.

It is contemplated that the material from which the patterned retaining disc apparatus 10' is fabricated is preferably sufficiently flexible such that the edges of the perforations 8' will affirmatively grip and hold the fabricating material 22 inserted therein. Thus, as previously set forth, one material suitable for the uses contemplated herein is a polyethylene plastic. However, it should be clearly understood that the patterned retaining disc apparatus 10' may be constructed from any suitable material which is sufficiently flexible such that fabricating material 22 inserted in the perforations 18' will be affirmatively gripped and held thereby. Similarly, while the patterned retaining disc apparatus 10' is illustrated in FIGS. 2A–B as having a generally cylindrical shape and the patterned retaining disc 11' thereof is illustrated as having a generally circular shape, it should be clearly understood that the diameter of the patterned retaining disc 11' may be varied and/or the patterned retaining disc apparatus 10' may assume other geometric configurations, including configurations that are not bilaterally symmetrical. For example, it is fully contemplated that, rather than the smooth curve best shown in FIG. 2A, the sidewall 30' of the patterned retaining disc apparatus 10' may have any one of a wide variety of other shapes.

Figure 3A:
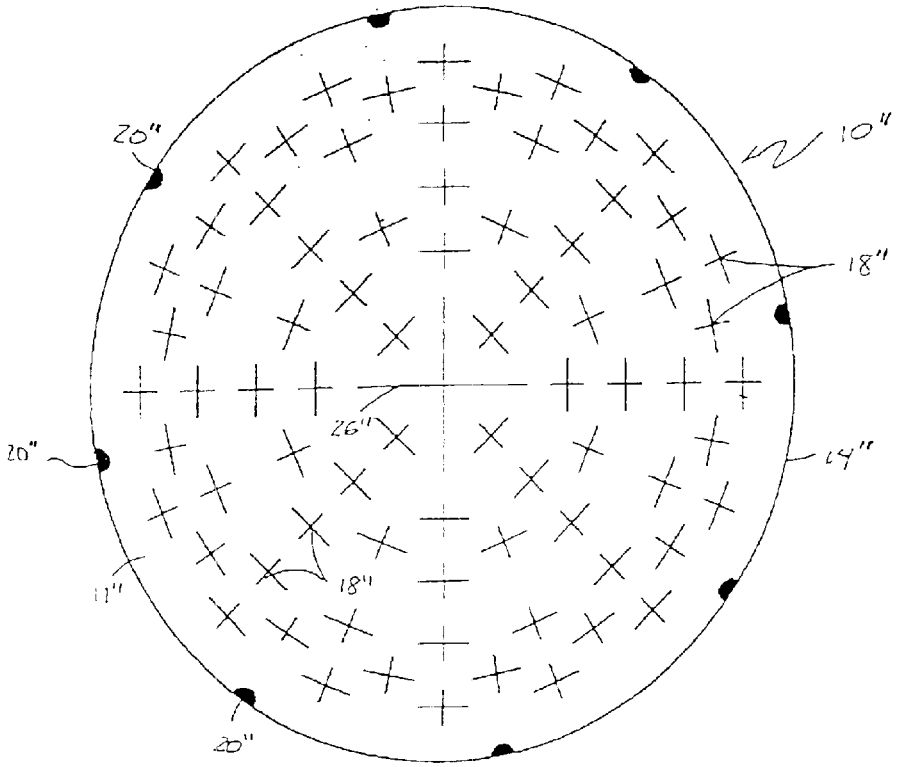
FIG. 3A is a top view of an alternate embodiment of the patterned retaining disc of FIGS. 2A–B.
Figure 3B:
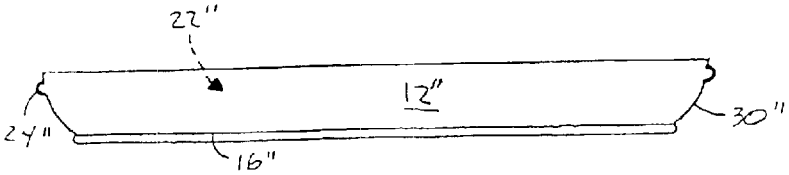
FIG. 3B is a side view of the patterned retaining disc of FIG. 3A.

Referring next to FIGS. 3A–B, still another alternate embodiment of the patterned retaining disc 10, hereafter referred to as patterned retaining disc apparatus 10", will now be described in greater detail. Similar to the patterned retaining disc apparatus 10', the patterned disc apparatus 10" is comprised of a patterned retaining disc 11" and a dish 12" sized to receive the patterned retaining disc 11" in an open side thereof. The dish 12" is comprised of a continuous curvilinear sidewall 30" extending upwardly from a generally flat, thickened, or rolled edge, bottom 16" to define an interior 22" (located immediately below the patterned retaining disc 11") for receiving material inserted through the perforations 18". Preferably, the patterned retaining disc 11" and the dish 12" are both formed using a flexible material such that the patterned retaining disc 11" may be affirmatively retained within the open side of the dish 12" by frictional engagement of the sidewall 30" of the dish 12" by an edge 14" of the patterned retaining disc 11" and the elastic deformation of the sidewall 30" by beads 20", representing thickened portions of the material comprising the patterned retaining disc 11", spaced radially around the circumference of the edge 14" for engaging the similarly spaced detents, or dimples, 24" formed in the sidewall 30" of the dish 12" to retain the patterned retaining disc 11" in the open side of the dish 12". Similar to the patterned retaining disc 11', a plurality of perforations are formed in the patterned retaining disc 11" in an "X" or "cross" shape to facilitate insertion of the fabricating material 22 into the perforations 18" in the manner described herein. The patterned retaining disc 11" is further provided with an enlarged slotted perforation 26", again formed in an "X" or "cross" shape, located at or near the center of the patterned retaining disc 11.

Figure 4:
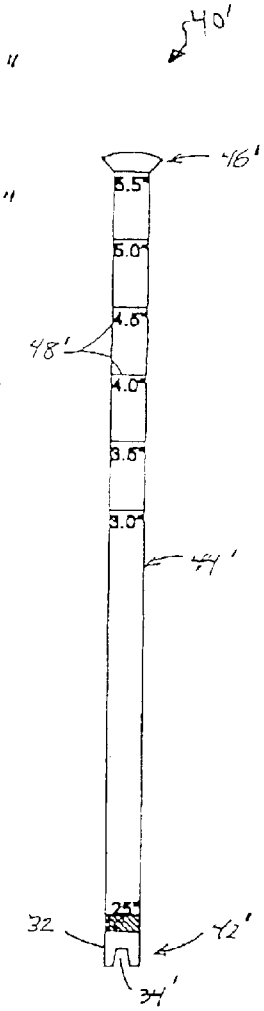
FIG. 4 is a side view of an alternate embodiment of the tool of FIG. 1D.

Referring next to FIG. 4, an alternate embodiment of the tool 40 hereafter referred to as tool 40', will now be described in greater detail. The tool 40' is comprised of a lower section 42', an elongated middle section 44' and a flanged upper section 46'. In this embodiment, the lower section 42' includes two blunt prongs 32' with a generally V-shaped notch 34' located therebetween. It is contemplated that the notch 34' may be used to trap the strip of fabricating material 22 from which the decorative arrangement is to be constructed, thereby facilitating the insertion of the strip of fabricating material 22 into the perforations 18 of the patterned retaining disc apparatus 10. The flanged upper section 46' is configured to facilitate gripping of the tool 40' during fabrication of the decorative arrangement, specifically, when inserting the strip of fabricating material 22 through the perforations 18 of the patterned retaining disc 10. Although not shown in FIG. 4, the tool 40' may also be provided with a plurality of small serrations or other surface structure that provides a roughened surface near the upper section 46', again, to facilitate gripping of the tool 40'. Similarly, the surface of the tool 40' near the upper section 46' may be overcoated with a material having a high coefficient of friction for this same purpose. The elongated middle section 44' of the tool 40' has a generally cylindrical, or rod-shaped, configuration and is provided with spaced markings 48 for measuring the length of each loop set at intervals beginning at the lower section 42' and extending towards the flanged upper end 46'.

Figure 5:
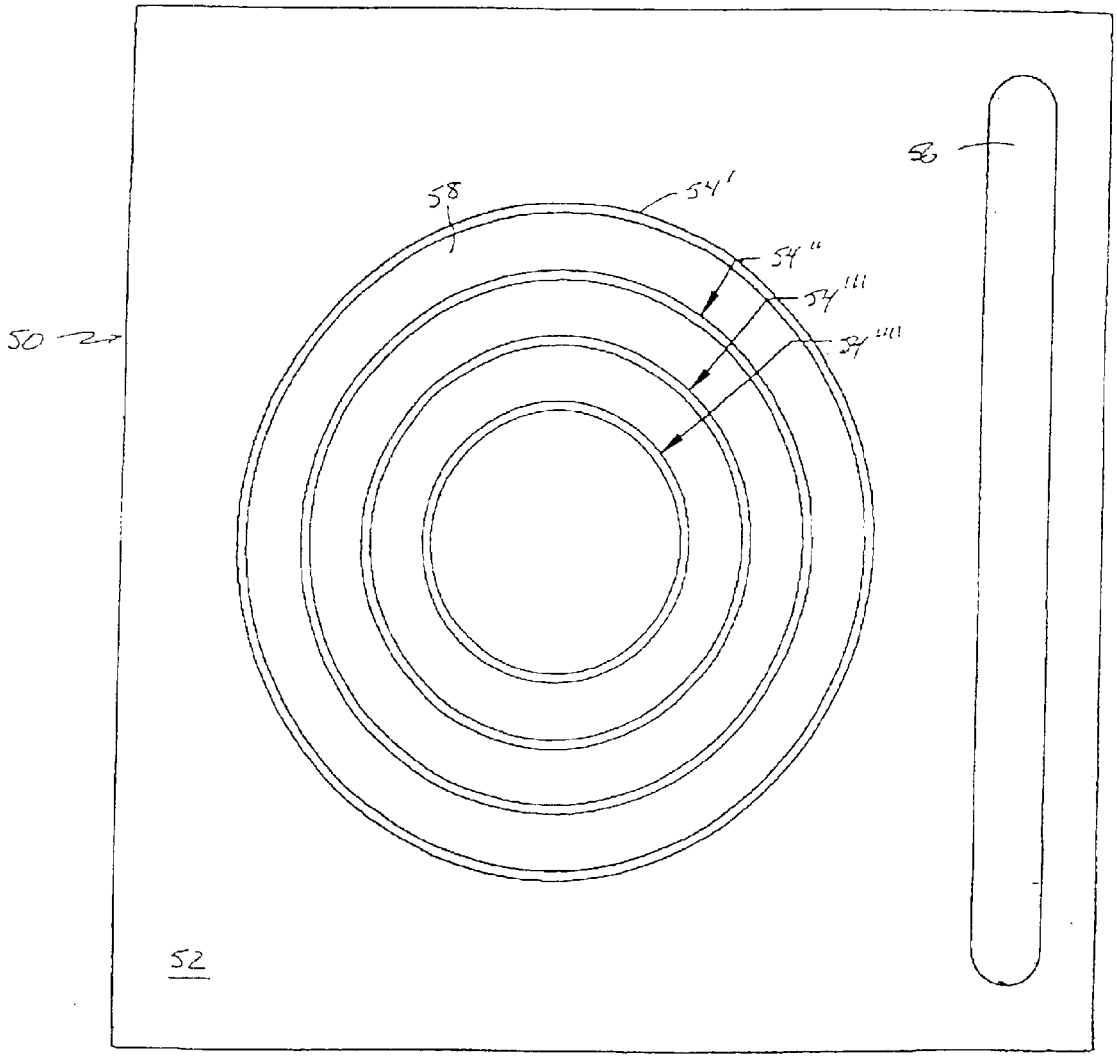
FIG. 5 is a top view of a base stand suitable for use with the patterned retaining disc of FIGS. 3A–B.

Referring next to FIG. 5, in still another embodiment of the invention, the decorative disc apparatus may include a base stand 50 having a generally flat upper side surface, an elongated well 56 for holding the tool 40 or 40' and a receptacle 58 for receiving the dish 12". Preferably, the base stand 50 is configured in a generally square shape and is molded from a resilient polymer in unitary fashion. The receptacle 58 for receiving the dish 12" is actually a depression, or well, formed in the top surface 52 of the stand 50 and is preferably comprised of a series of successively deeper wells, as represented by the concentric circles 54' through 54"". Each concentric circle 54' through 54"" defines a diameter that receives the bottom 16" of a dish 12" (not shown in FIG. 5) of like diameter, affirmatively retaining the dish 12" therein, to facilitate fabrication of a decorative arrangement when a like-sized patterned retaining disc 11" is snapped into the open side of the dish 12". If desired, the base stand 50 may be further provided with other integrally molded receptacles and supports (not shown in FIG. 5) to receive and store spools of bow fabricating materials, scissors, and other supplies needed for constructing decorative arrangements in accordance with the methods described herein. Of course, a table or other support surface may be used to support the dish 12" having the patterned retaining disc 11" retained therein.

While, as disclosed herein, the strip of fabricating material 22 used to construct a decorative arrangement is a ribbon, it should be clearly understood that a wide variety of materials other than ribbon or other fabrics may be used to construct decorative arrangements in accordance with the techniques disclosed herein. It should be further understood that other materials, for example, streamers, flowers, or greenery may be included in the decorative arrangement being constructed by inserting such materials into selected ones of the perforations 18 formed in the patterned retaining disc 10.

Thus, there has been described and illustrated herein, a method and apparatus for constructing decorative arrangements using a patterned retaining disc, a strip of material and a tool for inserting the strip of material into selected perforations formed in the patterned retaining disc. Flowever, those skilled in the art should recognize that numerous modifications and variations may be made in the techniques disclosed herein without departing substantially from the spirit and of the invention. Accordingly, the scope of the invention should only be ended hereto.

What is claimed is:

1. Apparatus for constructing decorative arrangements, comprising:

a disc member having at least two perforations formed therein, each of said at least two perforations being deformable, in response to application of a force thereto, to allow passage of fabricating material therethrough and returnable to their original shape, in response to removal of said force, to secure said fabricating material to said disc member; and a tool for inserting fabricating material into said at least two perforations formed in said disc member to form at least one loop of said fabricating material, said tool further comprising:

an end for forcibly inserting a portion of said fabricating material through a selected one of said plurality of perforations, and an intermediate section having a series of markings thereon, said series of markings used for measuring lengths of said fabricating material and said at least one loop formed thereby after said end of said tool has forcibly inserted said portion of said fabricating material through said selected one of said plurality of perforations.

2. The apparatus of claim 1, wherein said disc member has a plurality of perforations formed therein.

3. The apparatus of claim 2, wherein said plurality of perforations formed in said disc member are arranged in a pattern.

4. The apparatus of claim 1, and further comprising a pattern for identifying the order in which said plurality of perforations are selected for insertion of respective lengths of said fabricating material therethrough.

5. A method of constructing a decorative arrangement, comprising:

providing a disc member having a plurality of perforations arranged in a pattern formed therein;

deforming a first selected one of said plurality of perforations to allow passage of a strip of material therethrough;

inserting an end of said strip of material into said first selected one of said plurality of perforations while said first selected one of said plurality of perforations is deformed;

securing said end of said strip of material to said disc member by allowing said first selected one of said plurality of perforations to return to its original shape;

forming a first loop by inserting an intermediate section of said strip of material into a next one of said plurality of perforations; and repeating said forming step to add additional loops to decorative arrangement.

6. The method of claim 5, and further comprising the steps of:

providing a tool having an end and an intermediate section having a series of markings thereon;

said end of said tool used for forcibly inserting said strip of material through said plurality of perforations.

7. The method of claim 6, wherein the step of forming a first loop by inserting an intermediate section of said strip of material into a next one of said plurality of perforations further comprises the step of using said series of markings to measure the distance separating said perforation in which said end of said strip of material was inserted and said intermediate section of said strip of material.

8. The method of claim 7, wherein the step of forming a first loop by inserting an intermediate section of said strip of material into a next one of said plurality of perforations further comprises the steps of:

twisting said strip of material at said intermediate section thereof;

positioning said twisted intermediate section of said strip of material over said next one of said plurality of perforations; and inserting said intermediate section of said strip of material into said next one of said plurality of perforations.

9. The method of claim 5, wherein deforming a first selected one of said plurality of perforations to allow passage of a strip of material therethrough further comprises applying a force to said first selected one of said plurality of perforations.

10. The method of claim 9 wherein securing said end of said strip of material to said disc member by allowing said first selected one of said plurality of perforations to return to its original shape further comprises removing said force from said first selected one of said plurality of perforations.

11. The method of claim 5 wherein forming a first loop by inserting an intermediate section of said strip of material into a next one of said plurality of perforations further comprises:

deforming a second selected one of said plurality of perforations to allow passage of said intermediate section of said strip of material therethrough;

inserting said intermediate section of said strip of material into said second selected one of said plurality of perforations while said second selected one of said plurality of perforations is deformed; and securing said intermediate section of said length of said strip of material to said disc member by allowing said second selected one of said plurality of perforations to return to its original shape.

12. The method of claim 11, wherein:

deforming a first selected one of said plurality of perforations to allow passage of a strip of material therethrough further comprises applying a force to said first selected one of said plurality of perforations;

securing said end of said strip of material to said disc member by allowing said first selected one of said plurality of perforations to return to its original shape further comprises removing said force from said first selected one of said plurality of perforations;

deforming a second selected one of said plurality of perforations to allow passage of said intermediate section of said strip of material therethrough further comprises applying a force to said second selected one of said plurality of perforations; and securing said intermediate section of said length of said strip of material to said disc member by allowing said second selected one of said plurality of perforations to return to its original shape further comprises removing said force from said second selected one of said plurality of perforations.

13. An apparatus for constructing decorative arrangements, comprising:

a disc member having at least two perforations formed therein, each of said at least two perforations being deformable, in response to application of a force thereto, to allow passage of fabricating material therethrough and returnable to their original shape, in response to removal of said force, to secure said fabricating material to said disc member; and a tool for inserting fabricating material into said at least two perforations formed in said disc member to form at least one loop of said fabricating material;

wherein each one of said at least two perforations formed in said disc member is formed in an "X" shape.

14. The apparatus of claim 13, wherein said disc member is resiliently deformable.

15. An apparatus for constructing decorative arrangements, comprising:

a disc member having at least two perforations formed therein, each of said at least two perforations being deformable, in response to application of a force thereto, to allow passage of fabricating material therethrough and returnable to their original shape, in response to removal of said force, to secure said fabricating material to said disc member; and a tool for inserting fabricating material into said at least two perforations formed in said disc member to form at least one loop of said fabricating material;

wherein each one of said at least two perforations formed in said disc member is formed in an "Y" shape.

16. The apparatus of claim 15, wherein said disc member is resiliently deformable.

17. An apparatus for constructing decorative arrangements, comprising:

a disc member having at least two perforations formed therein, each of said at least two perforations being deformable, in response to application of a force thereto, to allow passage of fabricating material therethrough and returnable to their original shape, in response to removal of said force, to secure said fabricating material to said disc member; and a tool for inserting fabricating material into said at least two perforations formed in said disc member to form at least one loop of said fabricating material;

wherein said disc member includes four perforations formed along a first axis, four perforations formed along a second axis, six perforations formed along a third axis and six perforations formed along a fourth axis.

18. The apparatus of claim 17, wherein said first axis is a horizontal axis, said second axis is a vertical axis, said third axis is a first diagonal axis and said fourth axis is a second diagonal axis.

19. The apparatus of claim 18, wherein said disc member further includes two perforations formed along a fifth axis, two perforations formed along a sixth axis and an enlarged perforation formed in the general center thereof.

20. The apparatus of claim 19, wherein said fifth axis is a third diagonal axis located intermediate said horizontal axis and said first diagonal axis and said sixth axis is a fourth diagonal axis located intermediate said vertical axis and said second diagonal axis.

21. The apparatus of claim 17, wherein said disc member is resiliently deformable.

* * * * *